US008292397B2

(12) United States Patent
Tsubota

(10) Patent No.: US 8,292,397 B2
(45) Date of Patent: Oct. 23, 2012

(54) LIQUID EJECTING APPARATUS AND CONTROL METHOD THEREOF

(75) Inventor: Shinichi Tsubota, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 181 days.

(21) Appl. No.: 12/914,141

(22) Filed: Oct. 28, 2010

(65) Prior Publication Data

US 2011/0115842 A1 May 19, 2011

(30) Foreign Application Priority Data

Nov. 16, 2009 (JP) ..... 2009-260681

(51) Int. Cl.
*B41J 29/377* (2006.01)

(52) U.S. Cl. ..... 347/18; 347/14; 347/19; 347/92

(58) Field of Classification Search ..... 347/5, 9, 347/10, 14, 17–19, 92–93
See application file for complete search history.

(56) References Cited

U.S. PATENT DOCUMENTS

| | | | | |
|---|---|---|---|---|
| 5,459,498 | A * | 10/1995 | Seccombe et al. | 347/18 |
| 6,280,013 | B1 * | 8/2001 | Wade et al. | 347/17 |
| 6,631,966 | B2 * | 10/2003 | Watanabe et al. | 347/18 |
| 2009/0079773 | A1 | 3/2009 | Hosono et al. | |
| 2009/0295853 | A1 | 12/2009 | Hosono et al. | |
| 2009/0295854 | A1 | 12/2009 | Kawakami et al. | |

FOREIGN PATENT DOCUMENTS

| | | |
|---|---|---|
| JP | 2009-073074 | 4/2009 |
| JP | 2009-286074 | 12/2009 |
| JP | 2010-006048 | 1/2010 |

* cited by examiner

*Primary Examiner* — Juanita D Jackson
(74) *Attorney, Agent, or Firm* — Workman Nydegger

(57) ABSTRACT

In the ejection process in which the ink is ejected by using the ejection driving pulse, the ink is heated by a heating mechanism. On the other hand, in the maintenance process in which the ejection ability of the printing head is recovered by repeatedly applying the maintenance driving pulse to the piezoelectric oscillator, the ink is cooled by a cooling mechanism.

6 Claims, 7 Drawing Sheets

LIQUID EJECTING APPARATUS AND CONTROL METHOD THEREOF

The entire disclosure of Japanese Patent Application No: 2009-260681, filed Nov. 16, 2009 are expressly incorporated by reference herein.

BACKGROUND

1. Technical Field

The present invention relates to a liquid ejecting apparatus equipped with a liquid ejecting head such as an ink jet printing head, and a control method thereof, and particularly, relates to a liquid ejecting apparatus ejecting a liquid inside a pressure chamber from a nozzle by applying a variation in the pressure to the pressure chamber communicating with the nozzle, and a control method thereof.

2. Related Art

A liquid ejecting apparatus is an apparatus that includes a liquid ejecting head capable of ejecting a liquid and ejects various types of liquids from the liquid ejecting head. As a typical example of the liquid ejecting apparatus, for example, an image forming apparatus such as an ink jet printer (hereinafter, simply referred to as a printer) that includes an ink jet printing head (hereinafter, simply referred to as a printing head) as a liquid ejecting head and printing an image or the like by ejecting and landing liquid drop-shaped ink from a nozzle of the printing head onto a printing medium (ejection target) such as a printing sheet. In recent years, the application of the liquid ejecting apparatus has not been limited to an image forming apparatus, and the liquid ejecting apparatus has been applied to various manufacturing apparatuses. For example, in an apparatus for manufacturing a display such as a liquid crystal display, a plasma display, an organic EL (Electro Luminescence) display, or an FED (Field Emission Display), the liquid ejecting apparatus has been used in order to eject various liquid materials such as a color material or an electrode onto a pixel formation area or an electrode formation area.

The printing head includes a channel unit to which ink is introduced from a liquid storing portion such as an ink cartridge enclosing liquid ink therein and which is provided with a series of liquid channels formed from a reservoir to a nozzle via a pressure chamber or an actuator unit which has a pressure generating element capable of changing the volume of the pressure chamber. In the printing head, since the ink is thickened due to natural evaporation or a pressure loss is caused by bubbles mixed with the ink and absorbing a variation in the pressure, so-called dot skipping may be caused when no ink is ejected from the nozzle or the flight path may be curved. As a result, there is a problem in that ink ejection errors occur in the printing head.

In order to prevent such ink ejection errors, various maintenance processes are performed. For example, a maintenance process is performed, which forcibly removes the thickened ink or bubbles mixed with the ink by performing idle ejection of a liquid droplet (hereinafter, referred to as a flushing) from the nozzle in such a manner that a pressure generating element is driven to cause a variation in the pressure inside the pressure chamber. In order to further reliably discharge the bubbles existing in the liquid channel together with the liquid from the nozzle by the flushing, it is necessary to apply a comparatively large variation in the pressure as large as possible to the bubbles. Therefore, for example, JP-A-2009-73074 discloses a printer capable of generating a maintenance driving pulse having a large variation in the pressure to be applied to the inside of a pressure chamber by resonating a variation in the pressure to be applied to the pressure chamber in accordance with natural oscillation of the liquid generated inside the pressure chamber using the pressure generating element.

However, in recent years, there has been an attempt to make the printer eject a liquid (for example, UV ink (UV curable ink) or the like and hereinafter, referred to as a highly viscous liquid) having viscosity higher than that of a liquid (for example, water-based ink) used so far. That is, in the past, a liquid having a low viscosity of 1 to 5 mPa·s or so was used. However, in recent years, there has been an attempt to make the ink jet printer eject a highly viscous liquid having viscosity of 8 mPa·s or more. In order to obtain a sufficient ejection amount of the highly viscous liquid, it is necessary to eject the liquid after the printing head is heated to thereby decrease the viscosity of the liquid. However, when the temperature of the liquid is increased by heating the printing head, the solubility of the bubbles dissolved in the liquid decreases, and as a result, there is a tendency that the bubbles exceeding the solubility are easily discharged from the liquid into the liquid channel. For this reason, there is a problem in that the performance of discharging the bubbles is degraded even when the flushing process is performed in a high temperature state in which the solubility of the bubbles with respect to the liquid decreases.

SUMMARY

An advantage of some aspects of the invention is that it provides a liquid ejecting apparatus capable of enhancing the performance of discharging bubbles existing inside a liquid channel and a control method thereof.

An aspect of the invention provides a liquid ejecting apparatus including: a liquid ejecting head that causes a variation in the pressure inside a pressure chamber by operating a pressure generating mechanism and ejects a liquid filled in the pressure chamber from the nozzle; a heating mechanism that heats the liquid inside the liquid ejecting head; a cooling mechanism that cools the liquid inside the liquid ejecting head; a driving signal generating unit capable of generating a driving signal containing a driving pulse controlling the pressure generating mechanism; and a control unit that controls the heating mechanism, the cooling mechanism, and the driving signal generating unit, wherein the control unit generates a maintenance driving pulse which includes a first pulse component that changes the volume of the pressure chamber to enter a first state by driving the pressure generating mechanism, a second pulse component that maintains the first state for a predetermined time, and a third pulse component that changes the volume from the first state to a second state in which the volume of the pressure chamber is different from that of the first state, and which is used to remove bubbles inside the liquid filled in the pressure chamber by setting a variation in the pressure inside the pressure chamber to be larger than that of an ejection driving pulse ejecting the liquid to a landing target, and wherein the control unit heats the liquid by using the heating mechanism during an ejection process of ejecting the liquid using the ejection driving pulse, and cools the liquid by using the cooling mechanism during a maintenance process of recovering ejection ability of the liquid ejecting head by repeatedly applying the maintenance driving pulse to the pressure generating mechanism.

Further, the "removal of bubbles" indicates a phenomenon where to discharge the bubbles existing in the liquid, the bubbles dissolve in the liquid, and by ejecting the liquid from the nozzle the liquid and the bubbles existing in the liquid are discharged from the nozzle.

According to the above-described configuration, the control unit generates a maintenance driving pulse which includes a first pulse component that changes the volume of the pressure chamber to enter a first state by driving the pressure generating mechanism, a second pulse component that maintains the first state for a predetermined time, and a third pulse component that changes the volume from the first state to a second state in which the volume of the pressure chamber is different from that of the first state, and which is used to remove bubbles inside the liquid filled in the pressure chamber by setting a variation in the pressure inside the pressure chamber to be larger than that of an ejection driving pulse ejecting the liquid to a landing target. Also, the control unit heats the liquid by using the heating mechanism during an ejection process of ejecting the liquid using the ejection driving pulse, and cools the liquid by using the cooling mechanism during a maintenance process of recovering the ejection ability of the liquid ejecting head by repeatedly applying the maintenance driving pulse to the pressure generating mechanism. Accordingly, it is possible to enhance the solubility of the bubbles with respect to the liquid. Therefore, since it is possible to dissolve the bubbles in the liquid highly efficiently, it is possible to enhance the performance of discharging the bubbles existing inside the liquid channel. Further, since it is possible to highly efficiently discharge the bubbles, it is possible to shorten the time taken for the maintenance process.

Further, in the above-described configuration, the control unit may perform the maintenance process after the liquid is cooled to a predetermined cooling setting temperature by the cooling mechanism.

According to this configuration, since the control unit performs the maintenance process after the liquid is cooled to the predetermined cooling setting temperature by the cooling mechanism, it is possible to cause a variation in the pressure inside the pressure chamber while the temperature of the liquid further approaches the normal temperature, and thus to highly efficiently dissolve the bubbles in the liquid. Accordingly, it is possible to suppress needless consumption of the liquid.

Further, in the above-described configuration, the control unit may generate a high-temperature maintenance driving pulse and a low-temperature maintenance driving pulse set to have a larger variation in the pressure inside the pressure chamber than that of the case where the high-temperature maintenance driving pulse is applied to the pressure generating mechanism. The control unit may perform the maintenance process using the high-temperature maintenance driving pulse until the liquid reaches a predetermined cooling setting temperature after starting to cool the liquid by the cooling mechanism, and perform the maintenance process using the low-temperature maintenance driving pulse after the liquid is cooled to the cooling setting temperature.

According to this configuration, the control unit generates a high-temperature maintenance driving pulse and a low-temperature maintenance driving pulse and is set to have a larger variation in the pressure inside the pressure chamber than that of the case where the high-temperature maintenance driving pulse is applied to the pressure generating mechanism. The control unit performs the maintenance process using the high-temperature maintenance driving pulse until the liquid reaches a predetermined cooling setting temperature after the liquid is cooled by the cooling mechanism, and performs the maintenance process using the low-temperature maintenance driving pulse after the liquid is cooled to the cooling setting temperature. Accordingly, in the beginning of the maintenance process until the temperature of the liquid reaches the cooling setting temperature, it is possible to suppress the ejection amount of the liquid and to ensure the ejection reliability of the liquid. Further, in the end of the maintenance process when the temperature of the liquid reaches the cooling setting temperature, it is possible to highly efficiently dissolve the bubbles in the liquid. As a result, it is possible to shorten the time taken for the maintenance process.

Further, in the above-described configuration, the control unit may generate a high-temperature maintenance driving pulse and a low-temperature maintenance driving pulse set to have a larger variation in the pressure inside the pressure chamber than that of the case where the high-temperature maintenance driving pulse is applied to the pressure generating mechanism. The control unit may increase a generation ratio of the low-temperature maintenance driving pulse with respect to a generation ratio of the high-temperature maintenance driving pulse as the temperature of the liquid decreases.

According to this configuration, the control unit generates a high-temperature maintenance driving pulse and a low-temperature maintenance driving pulse set to have a larger variation in the pressure inside the pressure chamber than that of the case where the high-temperature maintenance driving pulse is applied to the pressure generating mechanism. The control unit increases a generation ratio of the low-temperature maintenance driving pulse with respect to a generation ratio of the high-temperature maintenance driving pulse as the temperature of the liquid decreases. Accordingly, since it is possible to cause a variation in the pressure inside the pressure chamber in accordance with the temperature of the liquid, it is possible to further highly efficiently dissolve the bubbles in the liquid.

Further, in the above-described configuration, the time interval of the second pulse component of the low-temperature maintenance driving pulse may be set to be shorter than that of the high-temperature maintenance driving pulse.

According to this configuration, the time interval of the second pulse component of the low-temperature maintenance driving pulse is set to be shorter than that of the high-temperature maintenance driving pulse. Accordingly, it is possible to further increase a variation in the pressure inside the pressure chamber than that of the case where the high-temperature maintenance driving pulse is applied to the pressure generating mechanism just by designing the maintenance driving pulse in which the time interval of the second pulse component is different from that of the high-temperature maintenance driving pulse.

Further, in the above-described configuration, the control unit may decrease the number of applications of the maintenance driving pulse to the pressure generating mechanism as the temperature of the liquid decreases.

According to this configuration, the control unit decreases the number of applications of the maintenance driving pulse to the pressure generating mechanism as the temperature of the liquid decreases. Accordingly, it is possible to apply the maintenance driving pulse to the pressure generating mechanism by the number of applications in accordance with a variation in the solubility of the bubbles resulted from an increase/decrease in the temperature of the liquid. As a result, it is possible to highly efficiently dissolve the bubbles in the liquid, and to shorten the time taken for the maintenance process while suppressing needless consumption of the liquid.

Further, in the above-described configuration, the cooling mechanism and the heating mechanism may include a common circulation channel, and adjust the temperature of the liquid inside the liquid ejecting head by circulating a heating medium filled in the circulation channel.

According to this configuration, the cooling mechanism and the heating mechanism include a common circulation channel, and adjust the temperature of the liquid inside the liquid ejecting head by circulating a heating medium filled in the circulation channel. Accordingly, it is possible to suppress the space used for disposing the cooling mechanism and the heating mechanism for adjusting the temperature of the liquid inside the liquid ejecting head.

Further, in the above-described configuration, the liquid ejecting head includes a nozzle formation member in which a plurality of the nozzles is arranged, and a channel formation substrate which is provided with a liquid storing space for storing the liquid to be supplied to the pressure chamber communicating with the nozzle, wherein the circulation channel may be disposed between the liquid storing space and the nozzle in the channel formation substrate.

According to this configuration, the liquid ejecting head includes a nozzle formation member in which a plurality of the nozzles is arranged, and a channel formation substrate which is provided with a liquid storing space for storing the liquid to be supplied to the pressure chamber communicating with the nozzle, wherein the circulation channel is disposed between the liquid storing space and the nozzle in the channel formation substrate. Accordingly, it is possible to accurately adjust the temperature of the liquid.

Further, another aspect of the invention provides a control method of a liquid ejecting apparatus including: a liquid ejecting head that causes a variation in the pressure inside a pressure chamber by operating a pressure generating mechanism and ejects a liquid filled in the pressure chamber from the nozzle; a heating mechanism that heats the liquid inside the liquid ejecting head; a cooling mechanism that cools the liquid inside the liquid ejecting head; a driving signal generating unit capable of generating a driving signal containing a driving pulse controlling the pressure generating mechanism; and a control unit that controls the heating mechanism, the cooling mechanism, and the driving signal generating unit, wherein the control unit generates a maintenance driving pulse which includes a first pulse component that changes the volume of the pressure chamber to enter a first state by driving the pressure generating mechanism, a second pulse component that maintains the first state for a predetermined time, and a third pulse component that changes the volume from the first state to a second state in which the volume of the pressure chamber is different from that of the first state, and which is used to remove bubbles inside the liquid filled in the pressure chamber by setting a variation in the pressure inside the pressure chamber to be larger than that of an ejection driving pulse ejecting the liquid to a landing target, and wherein the control unit heats the liquid by using the heating mechanism during an ejection process of ejecting the liquid using the ejection driving pulse, and cools the liquid by using the cooling mechanism during a maintenance process of recovering ejection ability of the liquid ejecting head by repeatedly applying the maintenance driving pulse to the pressure generating mechanism.

According to the control method, since the liquid is cooled by the cooling mechanism during the maintenance process even when the liquid is heated during the ejection process, it is possible to enhance the solubility of the bubbles with respect to the liquid. Therefore, since it is possible to highly efficiently dissolve the bubbles in the liquid, it is possible to enhance the performance of discharging the bubbles existing inside the liquid channel. Further, since it is possible to highly efficiently discharge the bubbles, it is possible to shorten the time taken for the maintenance process.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
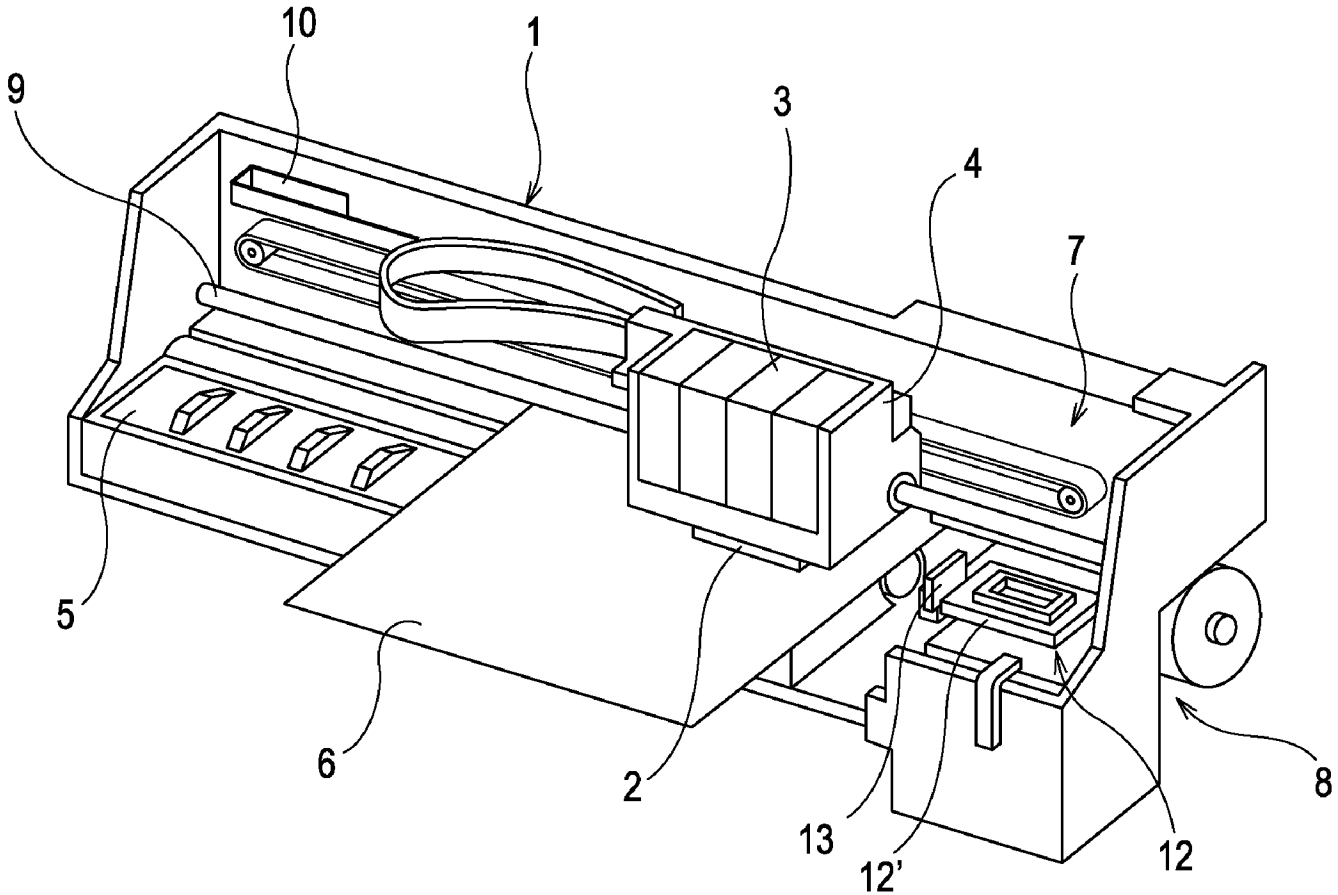
FIG. 1 is a perspective view illustrating a schematic configuration of a printer.

Hereinafter, exemplary embodiments of the invention will be described with reference to the accompanying drawings. In addition, in the exemplary embodiments to be described below, it should be understood that various preferred embodiments of the invention are not to be considered as limiting if there is no particular remark limiting the invention. Further, in the description below, an ink jet printing apparatus (hereinafter, simply referred to as a printer) shown in FIG. 1 is exemplified as the liquid ejecting apparatus of the invention.

A printer 1 schematically includes a carriage 4 to which a printing head 2 as a kind of liquid ejecting head is attached and to which an ink cartridge 3 storing ink (a kind of liquid of the invention) is detachably attached; a platen 5 which is disposed below the printing head 2; a carriage moving mechanism 7 which moves the carriage 4 mounted with the printing head 2 in the paper surface direction of a printing sheet 6 (kind of landing target); and a sheet transporting mechanism 8 which transports the printing sheet 6 in the sheet transporting direction as a direction perpendicular to the paper surface direction. Here, the paper surface direction is a primary scanning direction (head scanning direction), and the sheet transporting direction is a secondary scanning direction (that is, a direction perpendicular to the head scanning direction).

The carriage 4 is attached while being axially supported to a guide rod 9 that is installed in the primary scanning direction, and is adapted to move in the primary scanning direction along the guide rod 9 by the operation of the carriage moving mechanism 7. The position of the carriage 4 in the primary scanning direction is detected by a linear encoder 10, and a detection signal is transmitted to a control unit 56 (refer to FIG. 4) as position information. Accordingly, the control unit 56 is capable of controlling a printing operation (ejecting operation) using the printing head 2 while recognizing the scanning position of the carriage 4 (printing head 2) on the basis of position information obtained from the linear encoder 10.

A home position as a start position of a scanning operation is set in the end portion area on the outside (the right of FIG. 1) of the printing area within the movement range of the carriage 4. A capping mechanism 12 that seals a nozzle formation surface (nozzle plate 36: refer to FIG. 3) of the printing head 2 and a wiper member 13 that wipes the nozzle formation surface are disposed at the home position of the embodiment. Then, the printer 1 is configured to perform a bidirectional printing process of printing characters, images, or the like on the printing sheet 6 in both directions when the carriage 4 (printing head 2) moves forward from the home position to the opposite end portion and moves backward from the opposite end portion to the home position. In addition, a cap member 12' of the capping mechanism 12 is used as an ink receiving portion that receives ink droplets in a flushing process to be described later and performed to remove (eliminate) bubbles remaining in ink or thickened ink by performing idle ejection (wasting) of ink droplets.

Figure 2:
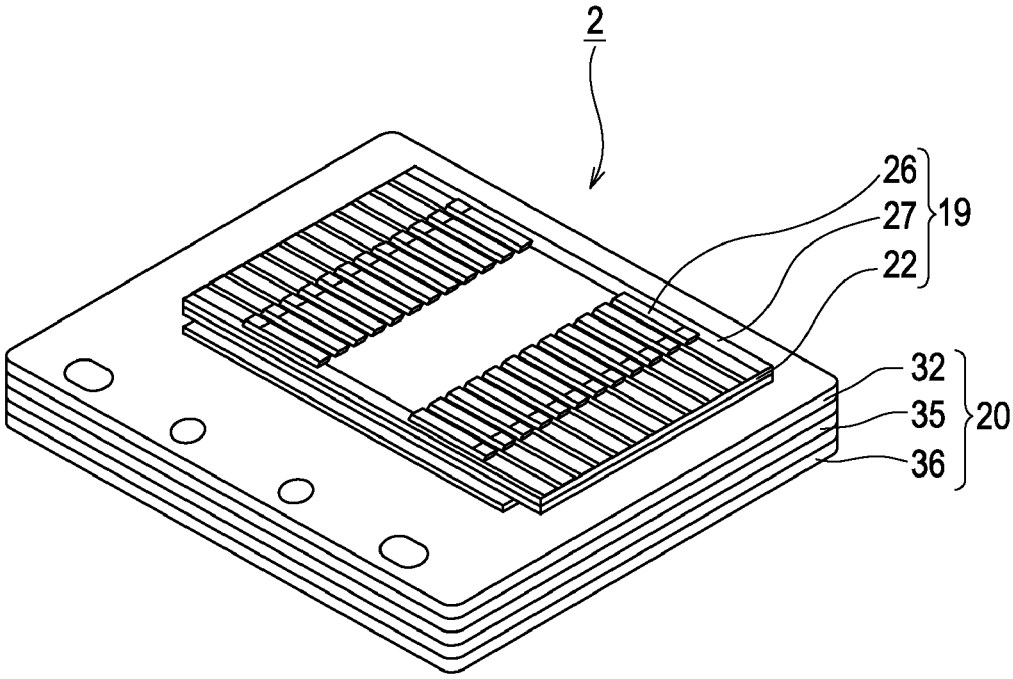
FIG. 2 is a perspective view illustrating a printing head when seen from the side of a pressure generating unit.
Figure 3:
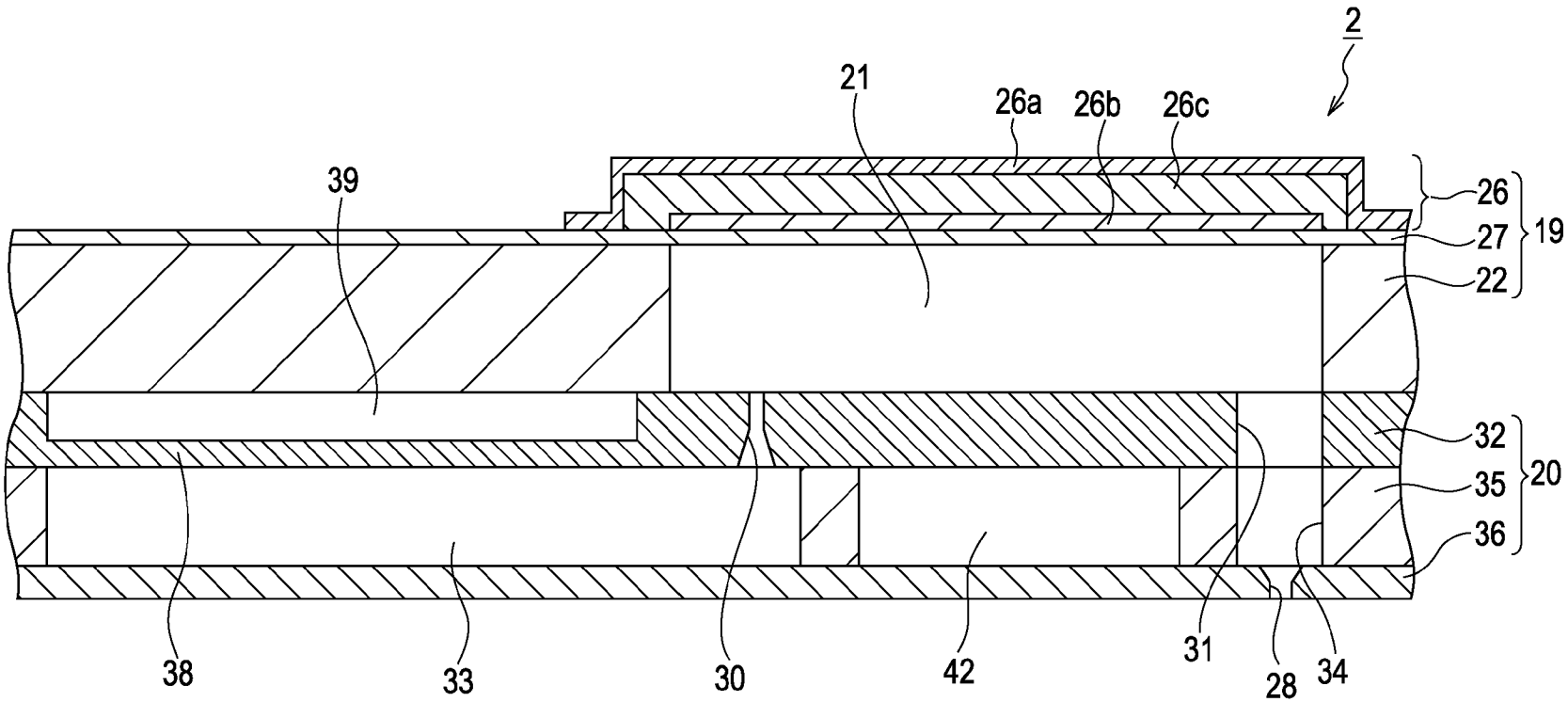
FIG. 3 is a cross-sectional view illustrating a configuration of a main part of the printing head.

Next, the configuration of the printing head 2 will be described. Here, FIG. 2 is a perspective view illustrating the printing head 2 when seen from the side of a pressure generating unit, and FIG. 3 is a cross-sectional view illustrating a main part of the printing head 2. The exemplified printing head 2 includes a pressure generating unit (or an actuator unit) 19 and a channel unit 20, which are integrated with each other in an overlapped state. The pressure generating unit 19 is formed in such a manner that a piezoelectric oscillator 26 (corresponding to a pressure generating mechanism of the invention), an oscillation plate 27, and a pressure generating chamber plate 22 for defining a pressure generating chamber (corresponding to a pressure chamber of the invention) 21 are laminated and integrated by burning or the like.

Further, the channel unit 20 is formed by laminating a supply port formation plate 32 that forms a supply port 30 or a second communication port 31, and a reservoir plate 35 (corresponding to a channel formation substrate of the invention) provided with a reservoir 33 (corresponding to a liquid storing space of the invention), a first communication port 34, and a circulation channel 42 that will be described later and adjusts a temperature of the ink inside the printing head 2 by circulating an enclosed heating medium. In addition, a nozzle plate 36 (corresponding to a nozzle formation member of the invention) provided with a nozzle opening 28 (corresponding to a nozzle of the invention) is provided on the surface of the reservoir plate 35 opposite to the supply port formation plate 32.

The oscillation plate 27 is formed by a plate member having elasticity. A plurality of piezoelectric oscillators 26 is disposed on the outer surface of the oscillation plate 27 on the opposite side of the pressure generating chamber 21 so as to respectively correspond to the pressure generating chambers 21. The exemplified piezoelectric oscillator 26 is a spreading oscillation mode oscillator, and includes a driving electrode 26*a*, a common electrode 26*b*, and a piezoelectric body 26*c* disposed therebetween. Then, when a driving signal is applied to the driving electrode of the piezoelectric oscillator 26, an electric field is generated between the driving electrode 26*a* and the common electrode 26*b* due to a difference in potential. The electric field is applied to the piezoelectric body 26*c*, and the piezoelectric body 26*c* is deformed in accordance with the magnitude of the applied electric field.

The pressure generating chamber plate 22 is formed by a thin ceramic plate having a thickness suitable for forming the pressure generating chamber 21, and is formed of, for example, alumina or zirconium, where a void portion for defining the pressure generating chamber 21 is formed to perforate the pressure generating chamber plate in the thickness direction. The pressure generating chamber 21 is installed in a line while having the same pitch as that of the nozzle opening 28 of the nozzle plate 36, and is a hole which is thin and long in the left/right direction perpendicular to the arrangement direction.

As shown in FIG. 3, the supply port formation plate 32 is a thin plate-shaped member that is formed of metal such as stainless steel. The supply port formation plate 32 has a plurality of support ports 30 that is formed to perforate the plate in the thickness direction. In addition, the second communication port 31 perforating the plate in the thickness direction is formed to correspond to the first communication port 34 of the reservoir plate 35. The supply port 30 is a portion that gives fluid resistance (flow resistance) to ink inside the ink channel (liquid channel). Regarding the supply port 30, as shown in FIG. 3, the diameter on the side of the reservoir 33 is widened more than that on the side of the pressure generating chamber 21. The supply port 30 is formed by a pressing process. In addition, the supply port formation plate 32 is provided with a compliance portion 38 that is sufficiently thinner than other portions. The compliance portion 38 is formed in such a manner that a concave portion 39 is formed by cutting in the thickness direction of the plate an area corresponding to the reservoir 33 of the reservoir plate 35 from the surface opposite to the reservoir 33 by an etching process or the like.

The reservoir plate 35 is a plate-shaped member that is formed of metal such as stainless steel. The reservoir plate 35 is provided with a void portion which perforates the plate in the thickness direction so as to define the reservoir 33. The void portion defines the reservoir 33. The reservoir 33 is a portion that serves as a liquid chamber used in common by the plurality of pressure generating chambers 21, and is provided for each type of colors of inks, where ink supplied from the ink cartridge 3 is stored therein. In addition, a plurality of the first communication ports 34 is formed while perforating the reservoir plate 35 in the thickness direction so as to correspond to the second communication ports 31.

The nozzle plate 36 is a plate-shaped member that is formed of metal such as stainless steel. In the nozzle plate 36, nozzle lines (nozzle opening groups), formed by arranging a plurality of nozzle openings 28 in a line, are formed to be parallel in the transverse direction, and in the embodiment, the nozzle lines are formed by 180 nozzle openings 28 installed at the same pitch (for example, 180 dpi). In addition, the nozzle plate 36 may be formed of an organic plastic film or the like instead of metal.

Then, the plate members are integrated by bonding the pressure generating unit 19 to the supply port formation plate 32, bonding the supply port formation plate 32 to the reservoir plate 35, and bonding the reservoir plate 35 to the nozzle plate 36. Accordingly, as shown in FIG. 3, the reservoir 33 communicates with the other end portion of the pressure generating chamber 21 via the supply port 30. In addition, one end portion of the pressure generating chamber 21 communicates with the nozzle opening 28 via the first communication port 34 of the reservoir plate 35 and the second communication port 31 of the supply port formation plate 32. Then, a series of ink channels (liquid channels) communicating from the reservoir 33 to the pressure generating unit 19 and the nozzle opening 28 via the pressure generating chamber 21 are provided for respective nozzle opening 28.

In the printing head 2 with the above-described configuration, the piezoelectric oscillator 26 is deformed to contract or expand the corresponding pressure generating chamber 21 and to cause a variation in the pressure of ink inside the pressure generating chamber 21. By controlling the ink pressure, ink can be ejected from the nozzle opening 28. When the pressure generating chamber 21 having a normal volume is preliminarily expanded before the ejection of ink, the ink is supplied from the reservoir 33 into the pressure generating chamber 21 via the supply port 30. In addition, when the pressure generating chamber 21 is abruptly contracted after the preliminary expansion, the ink is ejected from the nozzle opening 28.

Further, the printer 1 of the invention includes a heating mechanism that heats ink inside the printing head 2 and a cooling mechanism that cools ink inside the printing head 2. The heating mechanism and the cooling mechanism include the above-described common circulation channel 42, where water (which is a kind of heat media of the invention) is filled into the circulation channel 42, and the water is circulated while being used for heat exchange, thereby adjusting the temperature of the ink inside the printing head 2. The heating mechanism and the cooling mechanism include a heat exchanger 43 adjusting the temperature of the water, a pump 44 that circulates the water having the adjusted temperature inside the circulation channel 42, and a control unit 56 (refer to FIG. 4) that controls the heat exchanger 43 and the pump 44. In addition, the heating medium of the invention is not limited to water, and may be, for example, a liquid such as oil or alcohol. Further, the printer 1 of the invention facilitates the ejection of ink by decreasing the viscosity of the ink in such a manner that the temperature of the ink is increased by the heating mechanism during the ejection process in order to eject ink (highly viscous liquid) which has viscosity higher than that of water-based ink and is, for example, a light curable ink that is cured by the irradiation of optical energy such as UV light.

The circulation channel 42 is formed in an annular shape that is capable of circulating water filled therein, and as shown in FIG. 3, a part of the circulation channel 42 is disposed between the nozzle opening 28 and the reservoir 33 of the reservoir plate 35. The heat exchanger 43 is disposed in the course of the circulation channel 42, and includes a temperature control element (thermoelectric element) such as a Peltier element. The heat exchanger 43 is electrically connected to the control unit 56 (refer to FIG. 4), and cools or heats the water by receiving an electrical signal from the control unit 56. For example, the heat exchanger 43 heats the water by performing heat exchange between the thermoelectric element and the water during an ejection process in which the printing head 2 ejects ink onto the printing sheet 6. On the other hand, in a maintenance process in which thickened ink or bubbles mixed in the ink are forcibly removed by performing idle ejection of ink droplets from the nozzle opening 28 (hereinafter, referred to as a flushing) in such a manner that a larger variation in the pressure than that that of the ejection process is generated inside the pressure generating chamber 21, the water is cooled by reversing the polarity of current so as to be opposite to the polarity of current during a heating operation. Accordingly, the heating mechanism and the cooling mechanism adjust the temperature of the ink inside the printing head 2 by conducting the heat of the water having a temperature adjusted by the heat exchanger 43 and existing inside the circulation channel 42 to the ink inside the ink channel (specifically, the reservoir 33 and the nozzle opening 28).

Figure 4:
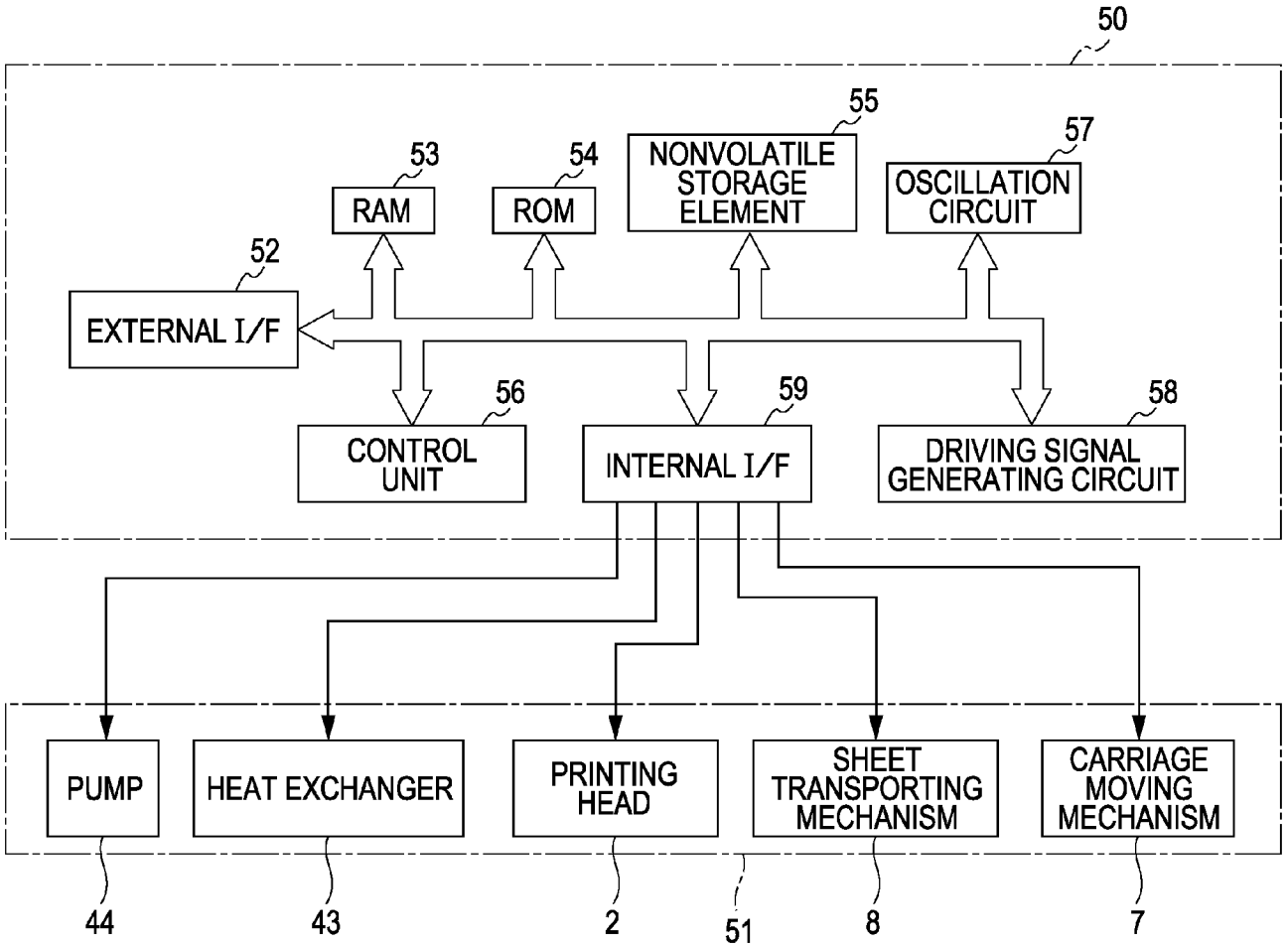
FIG. 4 is a block diagram illustrating an electrical configuration of the printer.

The pump 44 is disposed in the course of the circulation channel 42 similarly to the heat exchanger 43, and is electrically connected to the control unit 56 (FIG. 4). The pump 44 pressure-feeds the water filled inside the circulation channel 42 to the heat exchanger 58 by receiving an electrical signal from the control unit 56, and returns the water having a temperature adjusted by the heat exchanger 43 to the inside of the circulation channel 42, thereby adjusting the temperature of the ink inside the printing head 2.

Next, the electrical configuration of the printer 1 will be described. FIG. 4 is a block diagram illustrating an electrical configuration of the printer 1. The printer 1 of the embodiment schematically includes a printer controller 50 and a print engine 51. The printer controller 50 includes an external interface (external I/F) 52 to which print data or the like is input from an external device such as a host computer; a RAM 53 which stores various data or the like; a ROM 54 which stores a control program or the like for performing various controls; a nonvolatile storage element 55 which includes an EEPROM or a flash ROM; a control unit 56 which performs general control of respective units in accordance with the control program stored in the ROM 54; an oscillation circuit 57 which generates a clock signal; a driving signal generating circuit 58 (corresponding to a driving signal generating unit of the invention) which generates a driving signal COM to be supplied to the printing head 2; and an internal interface (internal I/F) 59 which outputs the driving signal or dot pattern data obtained by performing the print data for each dot to the printing head 2. The print engine 51 includes the printing head 2, the carriage moving mechanism 7, and the sheet transporting mechanism 8. In addition, the print engine 51 includes the heat exchanger 43 and the pump 44.

The control unit 56 performs the ejection control of ink droplets using the printing head 2 or the control of the other respective units of the printer 1 in accordance with the operation program or the like stored in the ROM 54. The control unit 56 converts print data input from the external device via the external I/F 52 into ejection data that is used for the ejection of the ink droplets in the printing head 2. The converted ejection data is transmitted to the printing head 2 via the internal I/F 59, and in the printing head 2, the supply of the driving signal COM to the piezoelectric oscillator 26 is controlled on the basis of the ejection data, thereby performing the ejection of the ink droplets, that is, the printing operation (ejection operation).

Here, the bubbles existing in the ink inside the ink channel of the printing head 2 will be described. In the printer 1, air may permeate via a wall surface or the like of the ink channel with the elapsing of time, and bubbles may be mixed with the ink due to the permeation or the like into the ink channel. Then, since such bubbles absorb a variation in the pressure, ejection errors may occur, such as a so-called dot skipping caused when no ink is ejected from the nozzle opening 28 or a curved flight path. For this reason, the printer 1 performs a flushing process as a maintenance process while the printing head 2 is moved to the home position to face the cap member 12' after the ejection process (printing process) in which ink is ejected onto the printing sheet 6 by the use of the ejection driving pulse so as to print text or images thereon. In the flushing process, the thickened ink or bubbles mixed in the ink are forcibly removed by repeatedly applying a maintenance driving pulse DP to be described later to the piezoelectric oscillator 26. However, in the printer 1 that ejects the ink having higher viscosity that that of the existing ink, since the ink inside the printing head 2 is heated by the heating mechanism during the ejection process, the temperature of the ink becomes higher than the normal temperature, and hence the viscosity of the ink decreases. As a result, the solubility of the bubbles with respect to the ink decreases. Then, since the bubbles in the ink channel cannot dissolve in the ink even when the flushing process is performed at the high temperature, the bubbles cannot be sufficiently discharged.

Therefore, in the printer 1 of the invention, the ink is heated by the heating mechanism during the ejection process, and the ink is cooled by the cooling mechanism during the maintenance process. Accordingly, the maintenance driving pulse DP is repeatedly applied to the piezoelectric oscillator 26 while the temperature of the ink is made (decreased) to be close to the normal temperature, and a variation in the pressure is used to repeatedly pressurize the pressure generating chamber 21, thereby highly efficiently dissolving the bubbles in the ink.

Figure 5A:
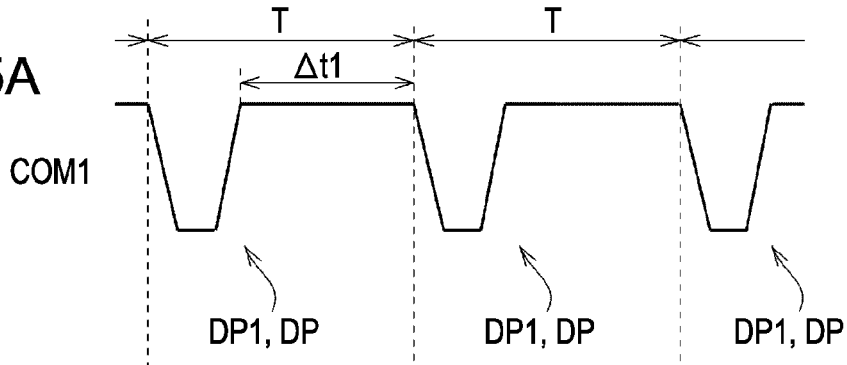
FIGS. 5A and 5B are waveform diagrams illustrating a configuration of a driving signal containing a maintenance driving pulse.
Figure 5B:
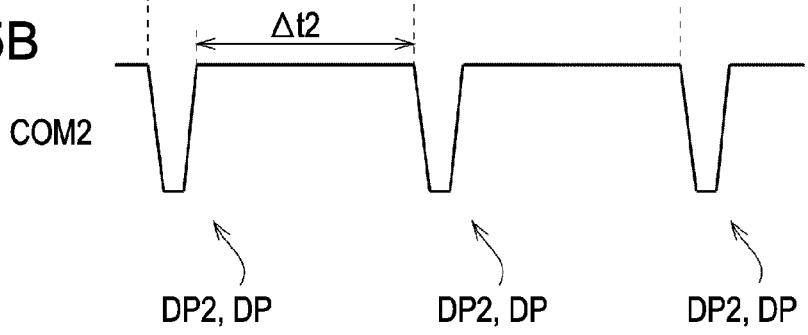
Figure 6A:
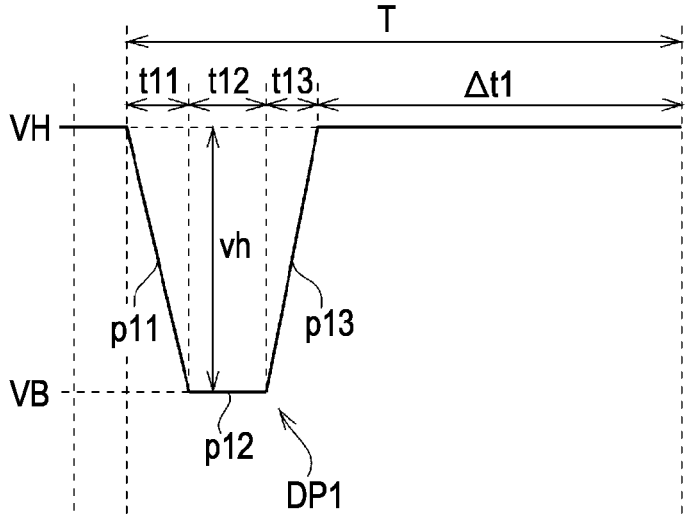
FIGS. 6A and 6B are waveform diagrams illustrating a configuration of a maintenance driving pulse.

FIG. 5A is a waveform diagram illustrating a configuration of the driving signal COM1 containing the maintenance driving pulse DP1 generated by the driving signal generating circuit 58 with the above-described configuration, and FIG. 6A is a waveform diagram illustrating a configuration of the maintenance driving pulse DP1. In FIGS. 5A, 5B, 6A, and 6B, the vertical axis is the potential of the driving signal. The horizontal axis is the time.

The printer 1 of the first embodiment is configured to generate the driving signal COM1 containing one maintenance driving pulse DP1 for controlling the driving state of the piezoelectric oscillator 26 within the region (one ejection period or one printing period) T corresponding to one pixel by sending an electrical signal to the driving signal generating circuit 58. The maintenance driving pulse DP1 is a driving pulse in which a variation in the pressure inside the pressure generating chamber 21 is set to be higher than that of the ejection driving pulse for ejecting ink onto the printing sheet 6 and which is used to remove the bubbles inside the ink filled in the pressure generating chamber 21. In addition, in the driving signal COM1 containing the maintenance driving pulse DP1 of the invention, one ejection performed by applying the driving signal COM1 having a predetermined frequency (for example, 5.4 kHz) within one ejection period T1 is set to a flushing unit [seg] (flushing segment). Then, in the maintenance process of performing the flushing process, the ink inside the ink channel is discharged from the nozzle opening 28 by repeatedly supplying the driving signals COM1 of a predetermined number of flushing segments (for example, tens of thousands to hundreds of thousands of segments) to the piezoelectric oscillator 26.

The maintenance driving pulse DP1 is a trapezoid-shaped pulse signal, and a difference in the potential between the maximum potential VH and the reference potential VB is set to Vh. The maintenance driving pulse DP1 has a start potential set to the maximum potential VH and an end potential set to the reference potential VB, and includes a first pulse component p11 that decreases the potential at a constant inclination from the maximum potential VH to the reference potential VB for a time interval t11; a second pulse component p12 that maintains the reference potential VB as the end potential of the first pulse component p11 for a predetermined time (a time interval t12); and a third pulse component p13 that has a start potential set to the reference potential VB and the end potential set to the maximum potential VH and increases the potential in accordance with a difference in the potential Vh having a constant inclination for a time interval t13.

When the maintenance driving pulse DP1 is applied to the piezoelectric oscillator 26, the pressure generating chamber 21 is expanded for the supply period of the first pulse component p11 from the minimum volume corresponding to the maximum potential VH to the maximum volume (reference volume) corresponding to the reference potential VB in accordance with the spreading deformation of the piezoelectric oscillator 26 (a first state), the maximum volume of the pressure generating chamber 21 is maintained for the supply period of the second pulse component p12 (a second state), and then the pressure generating chamber 21 is contracted for the supply period of the third pulse component p13 from the maximum volume to the minimum volume (a third state). Accordingly, the volume of the pressure generating chamber 21 can be changed from the minimum volume to the maximum volume, and then can be abruptly changed from the maximum volume to the minimum volume. Also, the variation in the pressure of the ink inside the pressure generating chamber 21 can be increased more than that of the ejection driving pulse used in the printing process. Then, in the maintenance process that repeatedly performs the flushing process, since the expansion and contraction of the pressure generating chamber 21 are repeated by using the maintenance driving pulse DP1, the bubbles receiving a variation in the pressure easily dissolve in the ink (that is, the dissolving of the bubbles into the liquid is promoted). As a result, in the maintenance process or the ejection process after the maintenance process, the ink is discharged from the nozzle opening 28 along with the bubbles.

Figure 7:
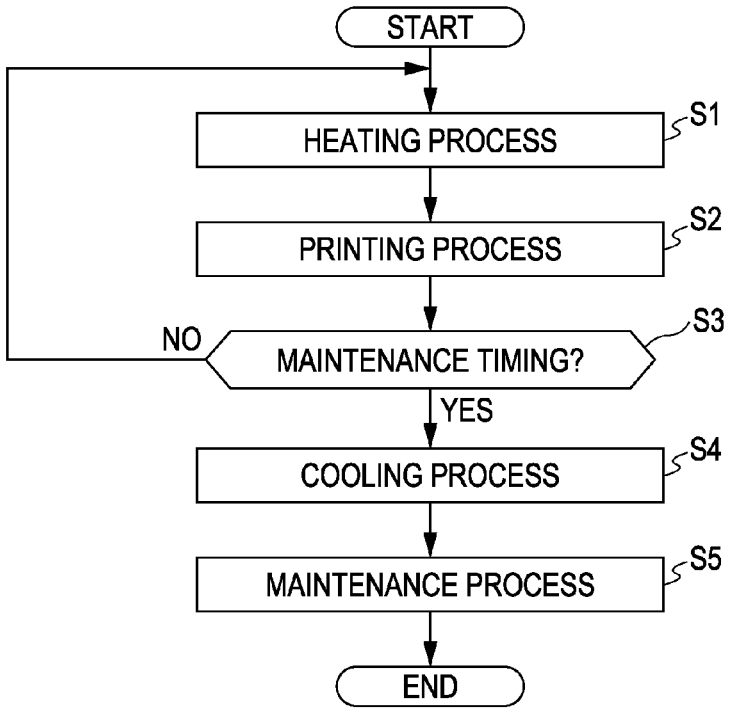
FIG. 7 is a flowchart illustrating a sequence of a maintenance process.

FIG. 7 is a flowchart illustrating the sequence of the maintenance process. In the embodiment, a heating process (S1) of increasing the temperature of the ink is performed by using the heating mechanism before the printing process, and during the printing process (S2), the control unit 56 determines whether or not the maintenance timing has arrived (S3). The maintenance timing is determined on the basis of whether any one of, for example, the elapsing time from the start time point of the printing process or the start time point of the precedent maintenance process during the printing process, the number of printed printing sheets 6, and the number of operations (passes) of the printing head 2 becomes a setting value. That is, the setting value corresponds to a process unit.

In step S3, when it is determined that the maintenance needs to be performed, the control unit 56 moves the printing head 2 to a position as the home position above the cap member 12' of the capping mechanism 12 by controlling the carriage moving mechanism 7. Then, a cooling process (S4) of decreasing the temperature of the ink is performed by using the cooling mechanism while the printing head 2 faces the cap member 12', and then a maintenance process (S5) as a flushing process is performed. In the flushing process, the flushing that forcibly performs the idle ejection of the ink from the nozzle opening 28 to a flushing point such as the cap member 12' of the capping mechanism 12 is carried out by causing a variation in the pressure larger than that of the printing process of the ink inside the pressure generating chamber 21 in a manner that the maintenance driving pulse DP is continuously applied to the piezoelectric oscillator 26. Accordingly, the bubbles inside the ink channel are discharged along with the ink.

Likewise, the control unit 56 of the printer 1 of the embodiment generates the maintenance driving pulse DP1 which includes the first pulse component p11 that changes the volume of the pressure generating chamber 21 to enter an expansion state by driving the piezoelectric oscillator 26; the second pulse component p12 that maintains the expansion state for a predetermined time; and the third pulse component p13 that changes the volume from an expansion state to a contraction state in which the volume of the pressure generating chamber 21 is different from that of the volume in the expansion state, where the maintenance driving pulse DP1 is used for removing the bubbles inside the ink filled in the pressure generating chamber 21 by setting a variation in the pressure inside the pressure generating chamber 21 to be larger than that of the ejection driving pulse for ejecting the ink onto the printing sheet 6. In the ejection process in which the ink is ejected by using the ejection driving pulse, the ink is heated by the heating mechanism. On the other hand, in the maintenance process in which the ejection ability of the printing head 2 is recovered by repeatedly applying the maintenance driving pulse DP1 to the piezoelectric oscillator 26, the ink is cooled by the cooling mechanism. Accordingly, the solubility of bubbles with respect to the ink can be enhanced. Therefore, since a variation in the pressure is applied to the bubbles, the bubbles can be highly efficiently dissolved in the ink, and the discharge performance of the bubbles existing inside the ink channel can be enhanced. In addition, since the bubbles can be highly efficiently discharged, the time taken for the maintenance process can be shortened.

Figure 8:
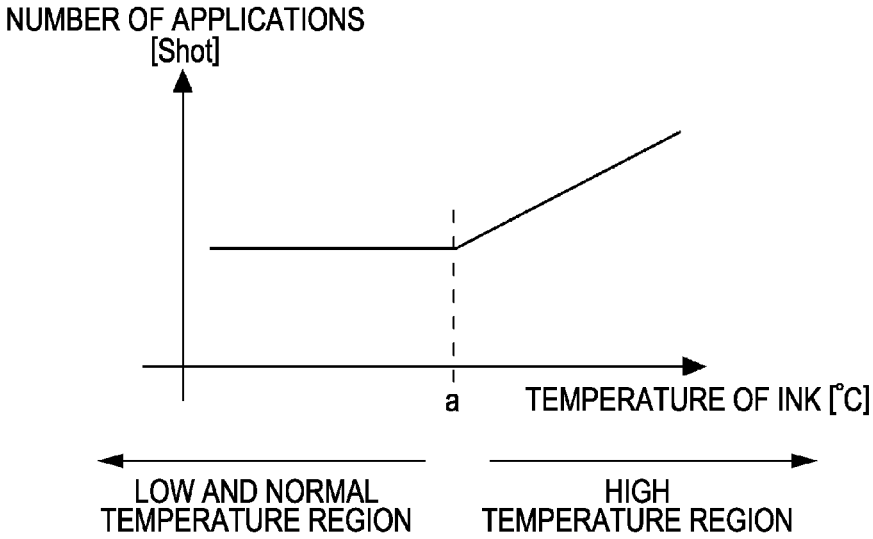
FIG. 8 is a graph illustrating a relationship between the temperature of the ink and the number of applications of maintenance driving pulses.

Here, FIG. 8 is a graph illustrating a relationship between the number of applications of the maintenance driving pulse DP and the temperature of the ink. In FIG. 8, the vertical axis is the number of applications of the maintenance driving pulse DP to be applied to the piezoelectric oscillator 26, and the horizontal axis is the temperature of the ink inside the printing head 2. In the printer 1 of the invention, as shown in FIG. 8, in a high temperature region in which the temperature of the ink is increased to be higher than the predetermined cooling setting temperature (which is denoted by the reference numeral a in FIG. 8 and is in the range of 20° C. to 28° C., for example, 25° C.) and in which the ink is cooled by the cooling mechanism, the number of applications of the maintenance driving pulse DP1 is decreased as the temperature of the ink decreases. On the other hand, in the low and normal temperature region in which the temperature of the ink is decreased to be lower than the cooling setting temperature a, the ink may be cooled by the cooling mechanism while maintaining the number of applications at the cooling setting temperature a. Accordingly, it is possible to apply the maintenance driving pulses DP1 to the piezoelectric oscillator 26 by the number of applications in accordance with a variation in the solubility of the bubbles resulted from an increase/decrease in the temperature of the ink. As a result, it is possible to highly efficiently dissolve the bubbles in the ink, and to shorten the time taken for the maintenance process while suppressing needless consumption of the ink. In addition, in the maintenance process, the number of applications of the maintenance driving pulse DP1 may be decreased throughout the entire region from the high temperature region where the ink is cooled by the cooling mechanism to the low and normal temperature region as the temperature of the ink decreases.

However, the invention is not limited to the above-described embodiment, and may be modified in various forms on the basis of the description of the claims.

The control unit 56 of the printer 1 of the second embodiment is configured to perform the maintenance process after the ink is lowered to the predetermined cooling setting temperature a by the cooling mechanism. With such a configuration, in the high temperature region where the temperature of the ink is high until the temperature of the ink is cooled to the predetermined cooling setting temperature a by the cooling mechanism, the maintenance process is not performed. On the other hand, in the low and normal temperature region where the temperature of the ink is decreased to be lower than the cooling setting temperature a, the maintenance process is performed, whereby a variation in the pressure can be caused inside of the pressure generating chamber 21 while the solubility of the bubbles with respect to the ink is enhanced more than that of the case of the high temperature, and the bubbles can highly efficiently dissolve in the ink. Accordingly, needless consumption of the ink can be suppressed.

Figure 6B:
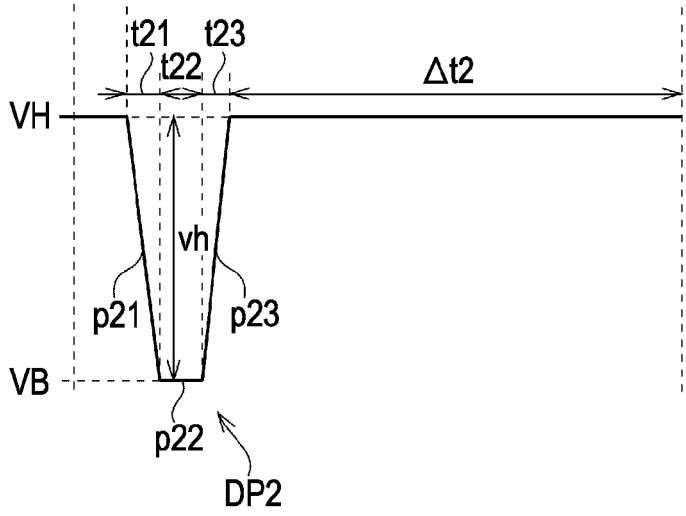

FIG. 5B is a waveform diagram illustrating a configuration of the driving signal COM2 containing the low-temperature maintenance driving pulse DP2 that is generated by the driving signal generating circuit 58 with the above-described configuration. FIG. 6B is a waveform diagram illustrating a configuration of the low-temperature maintenance driving pulse DP2.

In addition, the control unit 56 of the printer 1 of the third embodiment is configured to generate the driving signal COM1 that contains one maintenance driving pulse DP1 within one ejection period T, the maintenance driving pulse DP1 corresponding to the high-temperature maintenance driving pulse used in the high temperature region where the temperature of the ink is higher than the cooling setting temperature a, and the driving signal COM2 that contains one low-temperature maintenance driving pulse DP2 within one ejection period T, the low-temperature maintenance driving pulse DP2 being used in the low and normal temperature region where the temperature of the ink is decreased to be lower than the cooling setting temperature. For this reason, the driving signal generating circuit 58 of the embodiment generates the high-temperature maintenance driving pulse DP1 that is set to cause a larger variation in the pressure inside the pressure generating chamber 21 than that of the ejection driving pulse for ejecting the ink onto the printing sheet 6 during the printing process and is used to remove the bubbles inside the ink filled in the pressure generating chamber 21, and the low-temperature maintenance driving pulse DP2 that is set to have a larger variation in the pressure inside the pressure generating chamber 21 than that of the case where the high-temperature maintenance driving pulse DP1 is applied to the piezoelectric oscillator 26 and is used to remove the bubbles inside the ink filled in the pressure generating chamber 21. In addition, the time interval Δt1 between the high-temperature maintenance driving pulses DP1 in the driving signal COM1, and the time interval Δt2 between the low-temperature maintenance driving pulses DP2 in the driving signal COM2 are set so that the one ejection periods T of the driving signals COM1 and COM2 are uniform.

The low-temperature maintenance driving pulse DP2 is a trapezoid-shaped pulse signal, and a start potential set to the maximum potential VH and an end potential set to the reference potential VB. The low-temperature maintenance driving pulse DP2 includes a first pulse component p21 that deceases the potential at a constant inclination having a difference in the potential Vh for a time interval t21; a second pulse component p22 that maintains the reference potential VB as the end potential of the first pulse component p21 for a predetermined time (time interval t22) shorter than the time interval t12; and a third pulse component p23 that has the start potential set to the reference potential VB and the end potential set to the maximum potential VH and increases the potential at a constant inclination having a difference in the potential Vh for the time interval t23. When the low-temperature maintenance driving pulse DP2 is applied to the piezoelectric oscillator 26, the volume of the pressure generating chamber is expanded from the minimum volume to the maximum volume (reference volume) for the supply period of the first pulse component p21, the maximum volume thereof is maintained for the supply period of the second pulse component p22 having a time interval shorter than that of the second pulse component p12 of the high-temperature maintenance driving pulse DP1, and then the volume is contracted from the maximum volume to the minimum volume for the supply period of the third pulse component p23. Accordingly, since the time interval t22 of the second pulse component p22 is shorter than the time interval t12 of the first pulse component p12, the timing when the volume of the pressure generating chamber 21 changes becomes faster than the natural oscillation period Tc generated in the ink inside the pressure generating chamber 21, and the low-temperature maintenance driving pulse DP2 can increase the variation in the pressure generated inside the pressure generating chamber 21 more than that of the high-temperature maintenance driving pulse DP1 applied to the piezoelectric oscillator 26. In addition, since the low-temperature maintenance driving pulse DP2 is set so that at least one of the first pulse component p21 and the third pulse component p23 has an abrupt voltage variation rate, a variation in the pressure generated in the ink of the pressure generating chamber 21 may be set to be larger than that of the high-temperature maintenance driving pulse DP1 applied to the piezoelectric oscillator 26.

Further, the natural oscillation period Tc may be expressed by the following equation (1).

$$Tc=2\pi\sqrt{[\{(Mn\times Ms)/(Mn+Ms)\}\times Cc]} \quad (1)$$

In the equation (1), Mn denotes the inertance of the nozzle opening 28, Ms denotes the inertances of the communication ports 31 and 34 and the supply port 30, Cc denotes compliance (which represents a variation in the volume per the unit pressure and a degree of smoothness) of the pressure generating chamber 21.

In the equation (1), the inertance M indicates the easiness of the movement of the ink inside the ink channel, and the mass of the ink per unit sectional area. Then, when the density of the ink is denoted by ρ, the sectional area of the surface perpendicular to the circulation direction of the ink inside the channel is denoted by S, and the length of the channel is denoted by L, the inertance M can be approximately expressed by the following equation (2).

$$\text{Inertance } M=(\text{density } \rho\times\text{length } L)/\text{sectional area } S \quad (2)$$

Further, the invention is not limited to the equation (1), and the oscillation period of the pressure generating chamber 21 may be used.

With the above-described configuration, the control unit 56 performs the maintenance process by using the high-temperature maintenance driving pulse DP1 until the temperature of the ink reaches the predetermined cooling setting temperature a after the ink is cooled by the cooling mechanism, and performs the maintenance process by using the low-temperature maintenance driving pulse DP2 after the ink is cooled to the cooling setting temperature a. Accordingly, in the beginning of the maintenance process until the temperature of the ink reaches the cooling setting temperature, the high-temperature maintenance driving pulse DP1 is applied to the piezoelectric oscillator 26, thereby suppressing the ejection amount of the ink and ensuring the reliability of the ejection of the ink. Further, in the end of the maintenance process when the temperature of the ink is equal to or less than the cooling setting temperature a, the low-temperature maintenance driving pulse DP2 is applied to the piezoelectric oscillator 26, thereby highly efficiently dissolving the bubbles in the ink. As a result, the time taken for the maintenance process can be shortened. In addition, since the time interval of the second pulse component of the low-temperature maintenance driving pulse DP2 is set to be shorter than that of the high-temperature maintenance driving pulse DP1, the low-temperature maintenance driving pulse DP2 capable of further increasing a variation in the pressure inside the pressure chamber than that of the case where the high-temperature maintenance driving pulse is applied to the pressure generating mechanism can be easily generated just by designing the maintenance driving pulse in which the time interval of the second pulse component is different from that of the high-temperature maintenance driving pulse.

Further, the control unit 56 of the printer 1 of the fourth embodiment is configured to generate the high-temperature maintenance driving pulse DP1 and the low-temperature maintenance driving pulse DP2 of the third embodiment that is set to have a larger variation in the pressure inside the pressure chamber than that of the high-temperature maintenance driving pulse DP1 applied to the piezoelectric oscillator 26, and to increase the generation ratio of the low-temperature maintenance driving pulse DP2 with respect to the generation ratio of the high-temperature maintenance driving pulse DP1 as the temperature of the ink decreases. With this configuration, since a variation in the pressure in accordance with the temperature of the ink can be caused inside the pressure generating chamber 21, the bubbles can further highly efficiently dissolve in the ink.

Furthermore, in the above-described embodiments, the driving signals COM1 and COM2 shown in FIGS. 5A, 5B, 6A, and 6B are described as an example of the driving signal COM of the invention, but the shape of the pulse is not limited to the example. For example, an arbitrary waveform may be used. That is, in the above-described embodiments, an example has been described in which a so-called spreading oscillation mode piezoelectric element is used as the piezoelectric oscillator 26, but the piezoelectric element of the invention is not limited thereto. For example, a vertical oscillation mode piezoelectric element or the like may be adopted. In this case, the maximum potential VH and the reference potential VB are reversed. In addition, the piezoelectric oscillator 26 may be a magnetostrictor or the like, and may be a heating element when using the ink that generates bubbles.

Further, the number of segments of the maintenance process of performing the flushing may be set to an arbitrary value.

While the printer 1 as a kind of the liquid ejecting apparatuses has been exemplified, the invention may be applied to other liquid ejecting apparatuses. For example, the invention may be applied to a display manufacturing apparatus for manufacturing a color filter such as a liquid crystal display, an electrode manufacturing apparatus for forming an electrode such as an organic EL (Electro Luminescence) display or an FED (Field Emission Display), a chip manufacturing apparatus for manufacturing a biochip (biochemical element), and the like.

What is claimed is:

1. A liquid ejecting apparatus comprising:

a liquid ejecting head that causes a variation in the pressure inside a pressure chamber by operating a pressure generating mechanism and ejects a liquid filled in the pressure chamber from a nozzle;

a heating mechanism that heats the liquid inside the liquid ejecting head;

a cooling mechanism that cools the liquid inside the liquid ejecting head;

a driving signal generating unit capable of generating a driving signal containing a driving pulse controlling the pressure generating mechanism; and a control unit that controls the heating mechanism, the cooling mechanism, and the driving signal generating unit, wherein the control unit generates a first pulse which includes a first pulse component that changes the volume of the pressure chamber to enter a first state by driving the pressure generating mechanism, a second pulse component that maintains the first state for a predetermined time, and a third pulse component that changes the volume from the first state to a second state in which the volume of the pressure chamber is different from that of the first state, and which is used to remove bubbles inside the liquid filled in the pressure chamber by setting a variation in the pressure inside the pressure chamber to be larger than that of an ejection driving pulse ejecting the liquid to a landing target, and wherein the control unit heats the liquid by using the heating mechanism during an ejection process of ejecting the liquid using the ejection driving pulse, and cools the liquid by using the cooling mechanism during a maintenance process of recovering ejection ability of the liquid ejecting head by repeatedly applying the first pulse to the pressure generating mechanism.

2. The liquid ejecting apparatus according to claim 1, wherein the control unit performs the maintenance process after the liquid is cooled to a predetermined cooling setting temperature by the cooling mechanism.

3. The liquid ejecting apparatus according to claim 1, wherein the control unit generates a second pulse that is used for high-temperature maintenance and a third pulse that is used for low-temperature maintenance and is set to have a larger variation in the pressure inside the pressure chamber than that of the case where the second pulse is applied to the pressure generating mechanism, and wherein the control unit performs the maintenance process using the second pulse until the liquid reaches a predetermined cooling setting temperature after starting to cool the liquid by the cooling mechanism, and performs the maintenance process using the third pulse after the liquid is cooled to the cooling setting temperature.

4. The liquid ejecting apparatus according to claim 1, wherein the control unit generates a second pulse that is used for high-temperature maintenance and a third pulse that is used for low-temperature maintenance and is set to have a larger variation in the pressure inside the pressure chamber than that of the case where the second pulse is applied to the pressure generating mechanism, and wherein the control unit increases a generation ratio of the third pulse with respect to a generation ratio of the second pulse as the temperature of the liquid decreases.

5. The liquid ejecting apparatus according to claim 1, wherein the control unit decreases the number of applications of the first pulse to the pressure generating mechanism as the temperature of the liquid decreases.

6. The liquid ejecting apparatus according to claim 1, wherein the cooling mechanism and the heating mechanism include a common circulation channel, and adjust the temperature of the liquid inside the liquid ejecting head by circulating a heating medium filled in the circulation channel.

* * * * *